US009364882B2

(12) United States Patent
Yoshimichi et al.

(10) Patent No.: US 9,364,882 B2
(45) Date of Patent: Jun. 14, 2016

(54) ROLLER HEMMING DEVICE AND ROLLER HEMMING METHOD

(71) Applicant: HONDA MOTOR CO., LTD., Tokyo (JP)

(72) Inventors: Hitoshi Yoshimichi, Tochigi (JP); Hiroshi Miwa, Tochigi (JP); Kazuya Hirose, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/399,402

(22) PCT Filed: May 8, 2013

(86) PCT No.: PCT/JP2013/062944
§ 371 (c)(1),
(2) Date: Nov. 6, 2014

(87) PCT Pub. No.: WO2013/168743
PCT Pub. Date: Nov. 14, 2013

(65) Prior Publication Data

US 2015/0121984 A1 May 7, 2015

(30) Foreign Application Priority Data

May 8, 2012 (JP) ..... 2012-106870

(51) Int. Cl.
*B21D 19/04* (2006.01)
*B21D 39/02* (2006.01)
(Continued)

(52) U.S. Cl.
CPC ..... *B21D 19/043* (2013.01); *B21B 27/02* (2013.01); *B21B 31/18* (2013.01); *B21D 39/023* (2013.01)

(58) Field of Classification Search
CPC .. B21D 19/043; B21D 39/023; B21D 39/021; B21D 19/046; B21D 19/06; B21B 31/18; B21B 27/02
See application file for complete search history.

(56) References Cited

U.S. PATENT DOCUMENTS 7,934,408 B2 * 5/2011 Hasegawa ..... B21D 19/043 29/243.58
2008/0092618 A1 4/2008 Hasegawa et al.
(Continued)

FOREIGN PATENT DOCUMENTS

CN 101920284 12/2010
GB 2443076 4/2008
(Continued)

OTHER PUBLICATIONS

Machine translation of JP11-314121, Yokoyama et al., Nov. 16, 1999, JPO.*
(Continued)

*Primary Examiner* — Alexander P Taousakis
*Assistant Examiner* — Mohammad I Yusuf
(74) *Attorney, Agent, or Firm* — Rankin, Hill & Clark LLP

(57) ABSTRACT

A roller hemming device includes a large diameter roller having a large tapered surface and a small diameter roller having a small cylindrical surface. The small diameter roller is coaxially disposed with the large diameter roller. The small diameter roller and the large diameter roller enable to relatively move in an axial direction. The outer diameter of the small cylindrical surface is smaller than the minimum outer diameter of the large tapered surface.

4 Claims, 6 Drawing Sheets

(51) Int. Cl.
*B21B 27/02* (2006.01)
*B21B 31/18* (2006.01)

(56) References Cited

U.S. PATENT DOCUMENTS

| | | | |
|---|---|---|---|
| 2010/0313621 | A1 | 12/2010 | Kumagai et al. |
| 2011/0107807 | A1 | 5/2011 | Sato et al. |

FOREIGN PATENT DOCUMENTS

| | | |
|---|---|---|
| JP | H08-174100 | 7/1996 |
| JP | 11-314121 | 11/1999 |
| JP | 2003-103325 | 4/2003 |
| JP | 3824777 | 7/2006 |
| JP | 2008-100272 | 5/2008 |
| JP | 2010-194568 | 9/2010 |

OTHER PUBLICATIONS

International Search Report, Date of mailing: Aug. 6, 2013 (Jun. 8, 2013).

Chinese Office Action dated Jun. 8, 2015, 6 pages.

European Search Report dated Feb. 16, 2016, 7 pages.

* cited by examiner

ROLLER HEMMING DEVICE AND ROLLER HEMMING METHOD

TECHNICAL FIELD

The present invention relates to a roller hemming device and a roller hemming method.

BACKGROUND ART

Patent literature 1 discloses a device having both a roller for a preliminary bending which has a tapered surface and a roller for a regular bending which has a cylindrical shape and is spline-fitted to an outer circumference of the roller for preliminary bending. The roller for the regular bending coaxially moves relative to the roller for the preliminary bending. The preliminary bending of a circumferential edge portion of a workpiece is performed in such a manner that the tapered surface of the roller for the preliminary bending abuts on a flange in a state where the roller for the preliminary bending protrudes more than the roller for the regular bending. Subsequently, the roller for the regular bending is moved forward and the roller for the preliminary bending is accommodated in the roller for the regular bending, and then the roller for the regular bending performs the regular bending on the circumferential edge portion of the workpiece subjected to the preliminary bending.

However, in a piece of technology disclosed in patent literature 1, the preliminary bending is performed by the tapered surface of the roller for the preliminary bending which has a small diameter allowing the roller for the preliminary bending to be accommodated in the roller for the regular bending. Thus, in some cases, the flange subjected to the preliminary bending has a wave shape. The reason for this is as follows. In the tapered surface of the roller for the preliminary bending having a small diameter, the circumferential ratio between a large-diameter portion and a small-diameter portion in the tapered surface is great and the radius of curvature on the small-diameter portion side is small. In addition, the regular bending is performed by the roller for the regular bending having a large diameter. Thus, when an obstacle is located on the flange side, for example, when an inner panel protrudes up to a portion above the circumferential edge portion of the workpiece on which hemming processing is to be performed, the roller for the regular bending is likely to interfere with the obstacle. Accordingly, in some cases, the regular bending cannot be properly performed.

RELATED ART LITERATURE

Patent Literature

Patent Literature 1: Japanese Patent No. 3824777

SUMMARY OF THE INVENTION

According to a roller hemming device and a roller hemming method of an embodiment, a flange subjected to a preliminary bending is prevented from being in a wave shape, and a roller for a regular bending is prevented from interfering with an obstacle. Thus, both preliminary bending and regular bending can be properly performed.

MODE FOR CARRYING OUT THE INVENTION

Hereinafter, embodiments of the invention will be described with reference to the accompanying drawings.

Figure 1:
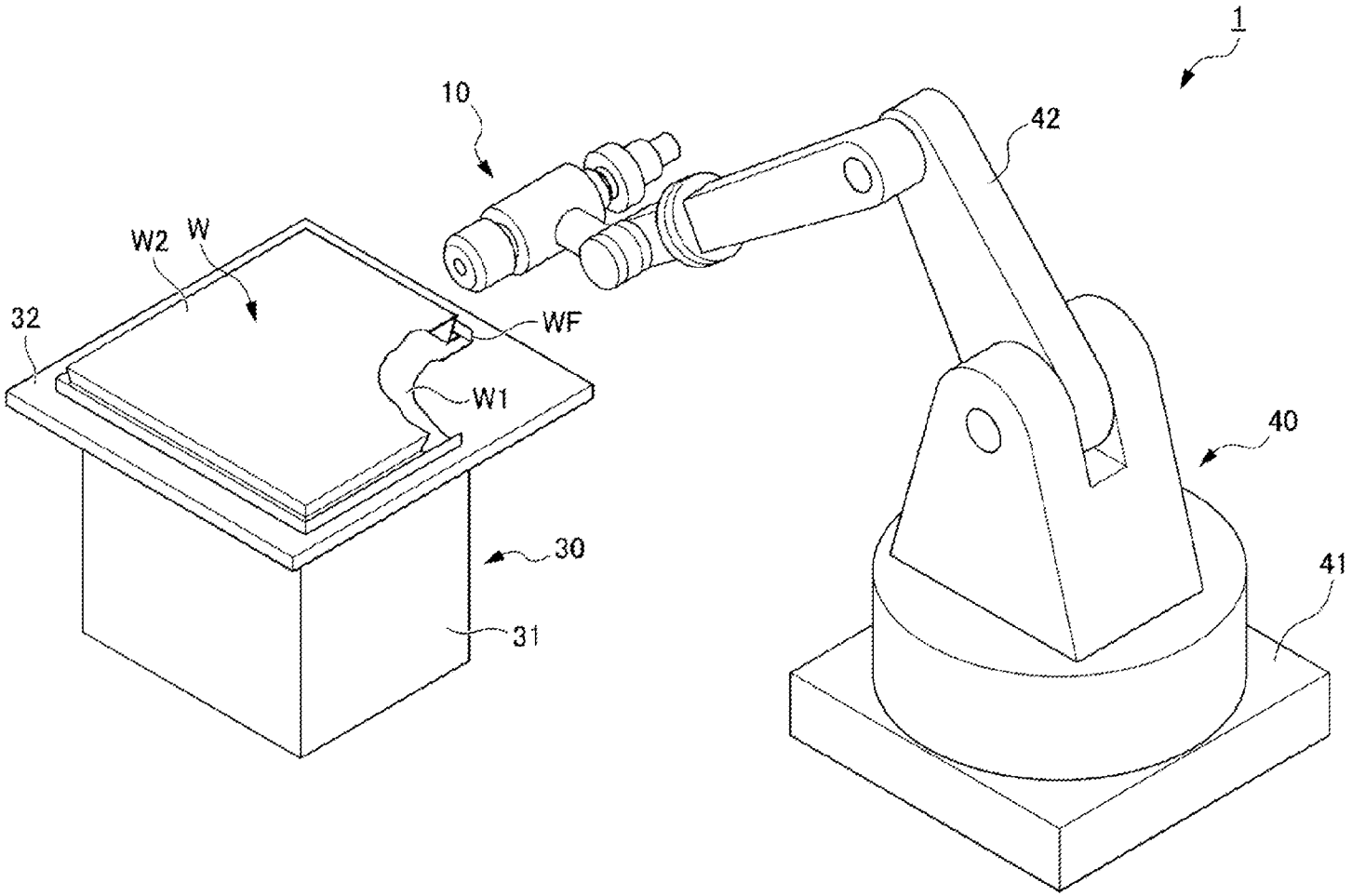
FIG. 1 is a view illustrating a schematic configuration of a roller hemming device according to a typical example.

FIG. 1 is a view illustrating a schematic configuration of a roller hemming device 1 to which a roller hemming device and a roller hemming method according to a typical example are applied. The roller hemming device 1 includes a machining table 30, a machining roller mechanism 10, and a robot 40.

The machining table 30 includes a support base 31 installed on a floor, and a table portion 32 supported by the support base 31. A workpiece W is mounted on the table portion 32. The workpiece W is, for example, a door panel for a vehicle. The workpiece W is constituted by an outer panel W1 and an inner panel W2. A flange WF of the outer panel W1 is bent at approximately 90°, relative to a circumferential edge portion of the inner panel W2. The circumferential edge portion is a remaining portion of the inner panel W2 except for a portion (a main body) on a central position. The inner panel W2 has a protruding portion W21 protruding up to a portion above the end portion W22, which is a portion subjected to temporal hemming processing, with respect to the end portion W22 subjected to hemming processing. The outer panel W1 is mounted on the table portion 32, in a state where the flange WF stands upward perpendicular to a surface of the table portion 32. The inner panel W2 is disposed on the outer panel W1, in a state where the flange WF of the outer panel W1 surrounds the end portion W22 of the inner panel W2.

The machining roller mechanism 10 performs bending processing (roller hemming processing) on the flange WF of the outer panel W1 mounted on the table portion 32. The machining roller mechanism 10 is supported by an arm 42 of the robot 40, in a state where the machining roller mechanism 10 can move in three-dimensional directions. The machining roller mechanism 10 can rotate relative to the arm 42. The roller hemming processing is performed, by the machining roller mechanism 10, generally through at least once preliminary bending and regular bending. In the preliminary bending, the flange WF is not bent up to a final bent shape. In the regular bending, the flange WF is bent to the final bent shape.

The robot 40 includes a base portion 41 which can travel on the floor and the arm 42 which supports the machining roller mechanism 10 in a state where the machining roller mechanism 10 can move in three-dimensional directions. The robot 40 moves the machining roller mechanism 10, in accordance with teaching data stored in advance. The robot 40 has a configuration in which, when the preliminary bending or the regular bending is performed, the machining roller mechanism 10 moves along a predetermined trajectory which is set, in advance, in accordance with teaching data.

Figure 2:
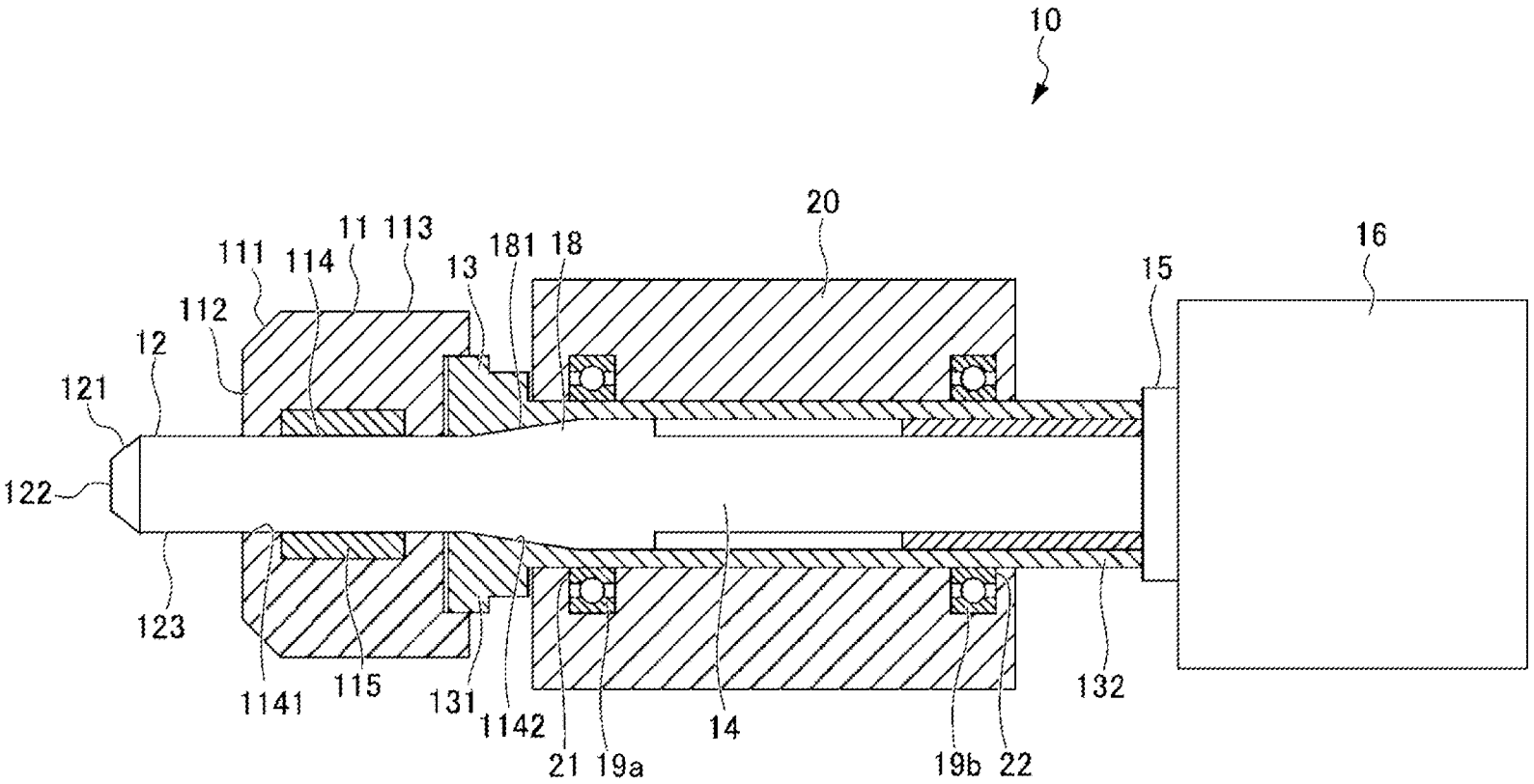
FIG. 2 is a schematic cross-sectional view illustrating an internal configuration of a machining roller mechanism according to the typical example.

FIG. 2 is a schematic cross-sectional view illustrating an internal configuration of the machining roller mechanism 10 according to the typical example. The machining roller mechanism 10 includes a large diameter roller 11 and a small diameter roller 12, as illustrated in FIG. 2.

The large diameter roller 11 is a member in a cylindrical shape. A large tapered surface 111 is formed on a front end of the large diameter roller 11, to perform the preliminary bending on the flange WF at a predetermined bending angle. A front end side of the large tapered surface 111 is a front end surface 112 which is formed in an annular shape and is perpendicular to an axial direction. A rear end side of the large tapered surface 111 of the large diameter roller has a large cylindrical surface 113 which continuously extends from the large tapered surface 111. A boundary between the large tapered surface 111 and the large cylindrical surface 113 of the large diameter roller 11 smoothly and continuously extends. A rear end side of the large diameter roller 11 is connected with a cylinder 13 in a cylindrical shape. In addition, the small diameter roller 12 is inserted into a hollow inner portion of the large diameter roller 11.

The small diameter roller 12 is a cylindrical member and installed in the large diameter roller 11. A small tapered surface 121 is formed on a front end of the small diameter roller 12, to perform the preliminary bending on the flange WF at a predetermined bending angle. A front end side of the small tapered surface 121 is a front end surface 122 which is formed in a circular shape and is perpendicular to the axial direction. A rear end side of the small tapered surface 121 of the small diameter roller 12 has a small cylindrical surface 123 which continuously extends from the small tapered surface 121. A boundary between the small tapered surface 121 and the small cylindrical surface 123 of the small diameter roller 12 smoothly and continuously extends. A core portion 14 of the small diameter roller 12, which is connected from the small cylindrical surface 123 to the rear end side extends through inner portions of both the large diameter roller 11 and the cylinder 13. The small diameter roller 12 is connected to the abutment member 15 on the rear end side. The outer diameter of the abutment member 15 is greater than that of the cylinder 13.

An abutment member 15 can be moved forward/rearward in the axial direction by an air cylinder 16 on a rear side, that is, the abutment member 15 can perform axial pressing. When the abutment member 15 is subjected to axial pressing toward the front end side, the abutment member 15 eventually abuts on a rear end 132 of the cylinder 13, and thus the rear end 132 is positioned.

An enlarged diameter portion 18 having an outer tapered surface 181 formed on the front end side is provided in a portion between the small diameter roller 12 and the core portion 14 disposed in the inner portion of the cylinder 13. The diameter of the enlarged diameter portion 18 is more enlarged than the diameter of the small diameter roller 12 or the diameter of the core portion 14. Meanwhile, an inner wall surface 114 of the hollow inner portion of the large diameter roller 11 is constituted by an inner circumferential surface 1141 and an inner tapered surface 1142. The inner circumferential surface 1141 has the same diameter as that of the small diameter roller 12 such that the small diameter roller 12 on the front end side can slide in the axial direction. The inner tapered surface 1142 extends from the inner circumferential surface 1141, in a state where the diameter of the inner tapered surface 1142 is enlarged. The outer tapered surface 181 of the enlarged diameter portion 18 on the rear end side abuts on the inner tapered surface 1142. A bearing portion 115 is provided in the inner circumferential surface 1141 to guide the small cylindrical surface 123 of the small diameter roller 12. When the abutment member 15 is moved forward toward the front end side, in accordance with an axial pressing operation to cause the small diameter roller 12 to protrude, and the abutment member 15 abuts on the rear end 132 of the cylinder 13, the small cylindrical surface 123 of the small diameter roller 12 is guided by the bearing portion 115. Furthermore, the outer tapered surface 181 of the enlarged diameter portion 18 is pressed against the inner tapered surface 1142 in the inner portion of the large diameter roller 11. In addition, the position of the axial center of the small diameter roller 12 is regulated to be coaxial with the large diameter roller 11. As a result, a protruding state of the small diameter roller 12 is fixed.

In the typical example, the abutment member 15 abuts on the rear end 132 of the cylinder 13 and the small cylindrical surface 123 of the small diameter roller 12 is guided by the bearing portion 115, as described above. Furthermore, the outer tapered surface 181 of the enlarged diameter portion 18 is pressed against the inner tapered surface 1142 in the inner portion of the large diameter roller 11. Since the three methods described above are performed, the protruding state of the small diameter roller 12 subjected to axial pressing is fixed in a state where the position of the axial center is prevented from being deviated. However, without being limited thereto, the protruding state of the small diameter roller 12 subjected to axial pressing may be fixed, using at least one of the three methods described above, in a state where the position of the axial center is prevented from being deviated.

A plurality of bearings 19*a*, 19*b* are provided on an outer circumference of the cylinder 13. The bearings 19*a*, 19*b* are interposed between the cylinder 13 and an outer cylinder 20 which is larger than the cylinder 13. Thus, the relative rotation is allowed between the cylinder 13 and the outer cylinder 20. Therefore, the large diameter roller 11 is freely rotatable relative to the outer cylinder 20. The bearing 19*a* is installed in a space portion 21 which is provided on the front end side of the outer cylinder 20. Meanwhile, the bearing 19*b* is installed in a space portion 22 which is provided on the rear end side of the outer cylinder 20.

Figure 3:
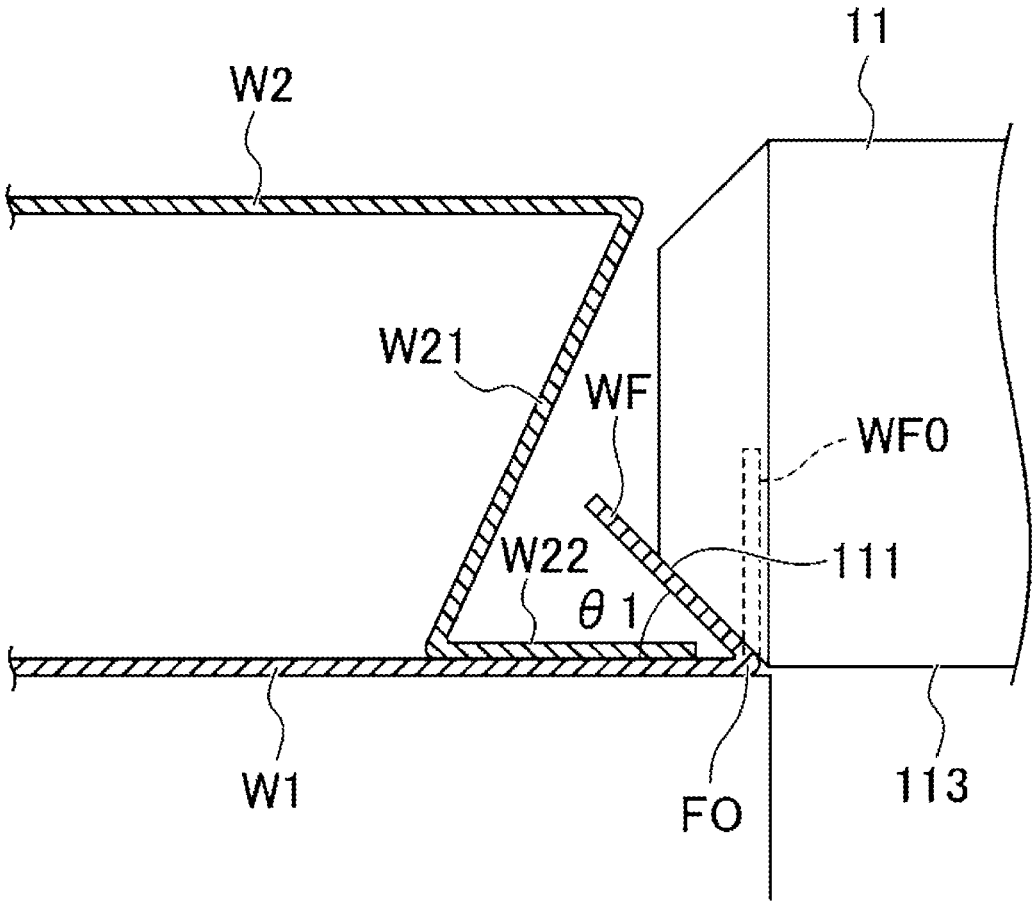
FIG. 3 is a view illustrating the machining roller mechanism according to the typical example, in a state where the machining roller mechanism performs a preliminary bending.

FIG. 3 is a view illustrating the machining roller mechanism 10 according to the typical example, in a state where the machining roller mechanism 10 performs the preliminary bending. The machining roller mechanism 10 and the robot 40 for moving the machining roller mechanism 10 perform the following preliminary bending. When the preliminary bending is performed, first, in a state where the workpiece W is mounted on the table portion 32, that is, a state WF0 where the flange WF is bent at approximately 90°, the large tapered surface 111 of the large diameter roller 11 comes into contact with the flange WF in the state WF0, as illustrated in FIG. 3. Then, the flange WF is pressed. The large tapered surface 111 of the large diameter roller 11 presses a base side of the flange WF, in which a bent portion FO is located. Accordingly, even in a case of the inner panel W2 according to the typical example, which has the protruding portion W21 which protrudes up to a portion above the end portion W22, as illustrated in FIG. 3, the large diameter roller 11 can the perform the preliminary bending without interference of the large diameter roller 11 with the inner panel W2. In this case, the flange WF is bent, at a bending angle θ1, directly below the large diameter roller 11. However, the remaining portion of the flange WF, which is not subjected to processing using the large diameter roller 11, is in the state WF0. The flange WF is continuously deformed from the state WF0 to the state in which the flange WF is bent at the bending angle θ1, as the flange WF extends from the remaining portion not subjected to processing using the large diameter roller 11 to the portion directly below the large diameter roller 11. Next, the large diameter roller moves along the bent portion FO, and thus the flange WF is bent in a predetermined shape. The angle θ1 may be, for example, 45'. In this case, the preliminary bending is not limited to being performed once and may be performed several times in accordance with the bending angle at which the flange WF is bent.

Figure 4:
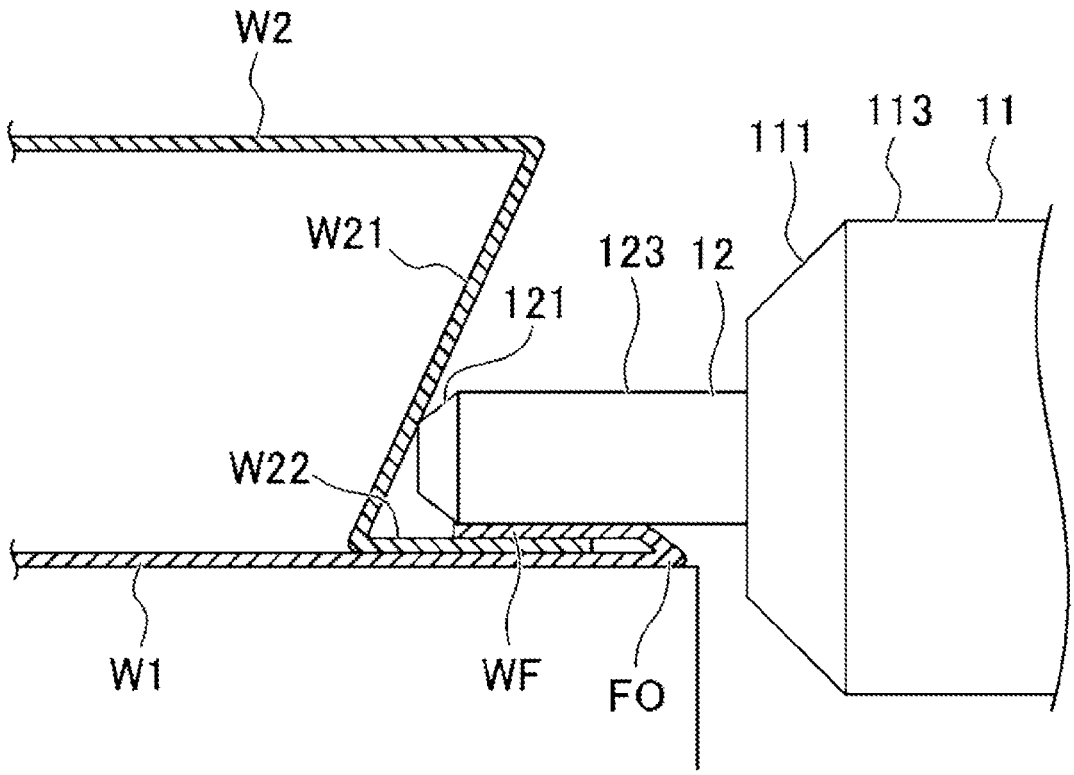
FIG. 4 is a view illustrating the machining roller mechanism according to the typical example, in a state where the machining roller mechanism performs a regular bending.

FIG. 4 is a view illustrating the machining roller mechanism 10 according to the typical example, in a state where the machining roller mechanism 10 performs the regular bending. When the preliminary bending is finished, the machining roller mechanism 10 and the robot 40 for moving the machining roller mechanism 10 perform the following regular bending. In the regular bending, the abutment member 15 is subjected to axial pressing toward the front end side using the air cylinder 16, and thus the abutment member 15 abuts on the rear end 132 of the cylinder 13. In this case, the small cylindrical surface 123 of the small diameter roller 12 is guided by the bearing portion 115 and the outer tapered surface 181 of the enlarged diameter portion 18 is pressed against the inner tapered surface 1142 in the inner portion of the large diameter roller 11, and thus the position of the axial center of the small diameter roller 12 is regulated. Accordingly, the small diameter roller 12 protrudes in a state where the small diameter roller 12 is positioned coaxially with the large diameter roller 11 and the axial center thereof is not deviated (see FIG. 4). Then, the small cylindrical surface 123 of the small diameter roller 12 in the protruding state presses the flange WF, similarly to the preliminary bending, and the small diameter roller 12 moves along the bent portion FO, similarly to the preliminary bending, as illustrated in FIG. 4. As a result, the flange WF is completely folded to the final shape. In the regular bending, the small cylindrical surface 123 of the small diameter roller 12 strongly bends the entirety of the flange WF, that is, the flange WF from the front end to the base in which the bent portion WO is located, to the extent that the flange WF comes into contact with the end portion W22 of the inner panel W2. Therefore, the end portion W22 of the inner panel W2 is interposed between the flange WF and the main body of the outer panel W1. In this case, the solid material contained in an adhesive gets into a portion between the outer panel W1 and the inner panel W2, and thus the outer panel W1 and the inner panel W2 are strongly bonded.

In this case, the inner panel W2 according to the typical example has the protruding portion W21 which protrudes up to the portion above the end portion W22. Thus, when the large cylindrical surface 113 of the large diameter roller 11 performs the regular bending, the inner panel W2 interferes with the large diameter roller 11. As a result, the large cylindrical surface 113 of the large diameter roller 11 cannot perform the regular bending. Here, the small cylindrical surface 123 of the small diameter roller 12 performs the regular bending, as illustrated in FIG. 4. Even when the inner panel W2 has the protruding portion W21 protruding up to the portion above the end portion W22, the small diameter roller 12 can enter through a gap between the protruding portion W21 and the end portion W22 of the inner panel W2, which is a gap above the flange WF. Thus, the small cylindrical surface 123 of the small diameter roller 12 can perform the regular bending without interference of the small diameter roller 12 with the inner panel W2.

Next, a roller hemming method using the roller hemming device 1 according to the typical example will be described. First, the outer panel W1 is mounted on the surface of the table portion 32. In this case, the outer panel W1 is in a state where the flange WF is bent upward at approximately 90°.

Next, the inner panel W2 is overlapped on a central portion (a main body) of the outer panel W1. The end portion W22 of the inner panel W2 is accommodated in an inner side of the flange WF of the main body of the outer panel W1. In this case, an adhesive is applied to both a portion between the main body of the outer panel W1 and the end portion W22 of the inner panel W2 and the folded surface of the flange WF.

Then, the robot 40 performs the preliminary bending, in accordance with the teaching data stored in advance. In other words, the large tapered surface 111 of the large diameter roller 11 presses the flange WF, as illustrated in FIG. 3. Pressing of the large diameter roller 11 against the flange WF may be performed as follows. The large diameter roller 11 moves, relative to the flange WF, parallel to the surface of the table portion 32. The large diameter roller 11 moves, relative to the flange WF, perpendicular to the surface of the table portion 32. The large diameter roller 11 moves, relative to the flange WF, perpendicular to an axis of the roller. The large tapered surface 111 of the large diameter roller 11 presses a base side of the flange WF, in which a bent portion FO is located. Next, the large diameter roller 11 is moved along the bent portion FO, and thus the large tapered surface 111 bends the flange WF in the state WF0. In this case, when the large diameter roller 11 moves along the bent portion FO, the large diameter roller 11 rotates on the flange WF. When the preliminary bending is performed, the flange WF is bent in the predetermined bent portion FO at the predetermined bending angle θ1.

Subsequently, the robot 40 performs the regular bending, in accordance with the teaching data stored in advance. In other words, the abutment member 15 is subjected to axial pressing using the air cylinder 16, and thus the small diameter roller 12 is moved to be in the protruding state, as illustrated in FIG. 4. Next, the small diameter roller 12 in the protruding state is inserted into a portion between the protruding portion W21 and the end portion W22 of the inner panel W2. Then, the small cylindrical surface 123 of the small diameter roller 12 presses the entirety of the flange WF, that is, the portion from the front end to the base. Next, the small cylindrical surface 123 of the small diameter roller 12 presses the flange WF, and then the small diameter roller 12 is moved along the bent portion FO. Accordingly, the flange WF is bent. The small cylindrical surface 123 of the small diameter roller 12 performs bending while maintaining a state where the small cylindrical surface 123 presses the entirety of the flange WF, that is, the portion from the front end to the base. In this case, when the small diameter roller 12 moves along the bent portion FO, the small diameter roller 12 rotates, along with the large diameter roller 11, on the flange WF. Accordingly, the flange WF is folded in the predetermined bent portion FO.

Since the regular bending is performed, and thus the flange WF is bent to the extent that the flange WF comes into contact with the end portion W22 of the inner panel W2, the end portion W22 of the inner panel W2 is interposed between the flange WF and the main body of the outer panel W1.

Subsequently, specific features of the machining roller mechanism 10 will be described. The preliminary bending can be performed using the large tapered surface 111 of the large diameter roller 11, as illustrated in FIG. 3. Therefore, the flange WF subjected to the preliminary bending is prevented from being in a wave shape, because the circumferential ratio between a large-diameter portion and a small-diameter portion is small in the large tapered surface 111 of the large diameter roller 11 and the radius of curvature on the small-diameter portion side is great.

Figure 5:
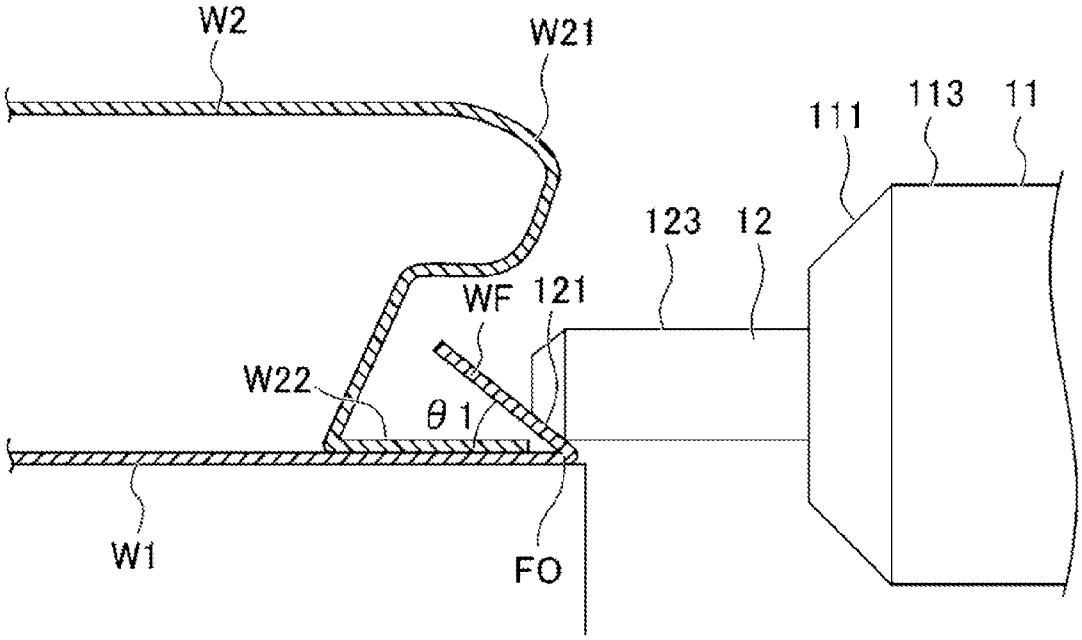
FIG. 5 is a view illustrating the machining roller mechanism according to the typical example, in a state where the machining roller mechanism performs another preliminary bending.

FIG. 5 is a view illustrating the machining roller mechanism 10 according to the typical example, in a state where the machining roller mechanism 10 performs another preliminary bending. Another preliminary bending can also be performed using the small tapered surface 121 of the small diameter roller 12, as illustrated in FIG. 5. Therefore, even when the protruding portion W21 of the inner panel W2 is large in size, and thus protrudes up to a portion above the end portion W22, as illustrated in FIG. 5, the small diameter roller 12 does not interfere with the protruding portion W21 of the inner panel W2, which is located above the flange WF. Accordingly, even when the large diameter roller 11 may interfere with the inner panel W2 or the like, the preliminary bending can be properly performed using the small tapered surface 121 of the small diameter roller 12.

The regular bending can be performed using the small cylindrical surface 123 of the small diameter roller 12, as illustrated in FIG. 4. Therefore, when the protruding portion W21 of the inner panel W2 protrudes up to a portion above the end portion W22, as illustrated in FIG. 4, the small diameter roller 12 can enter through a gap between the protruding portion W21 and the end portion W22 of the inner panel W2, which is a gap above the flange WF. Thus, the small diameter roller 12 is prevented from interfering with the inner panel W2. Furthermore, even in such a case, the regular bending can be properly performed.

Figure 6:
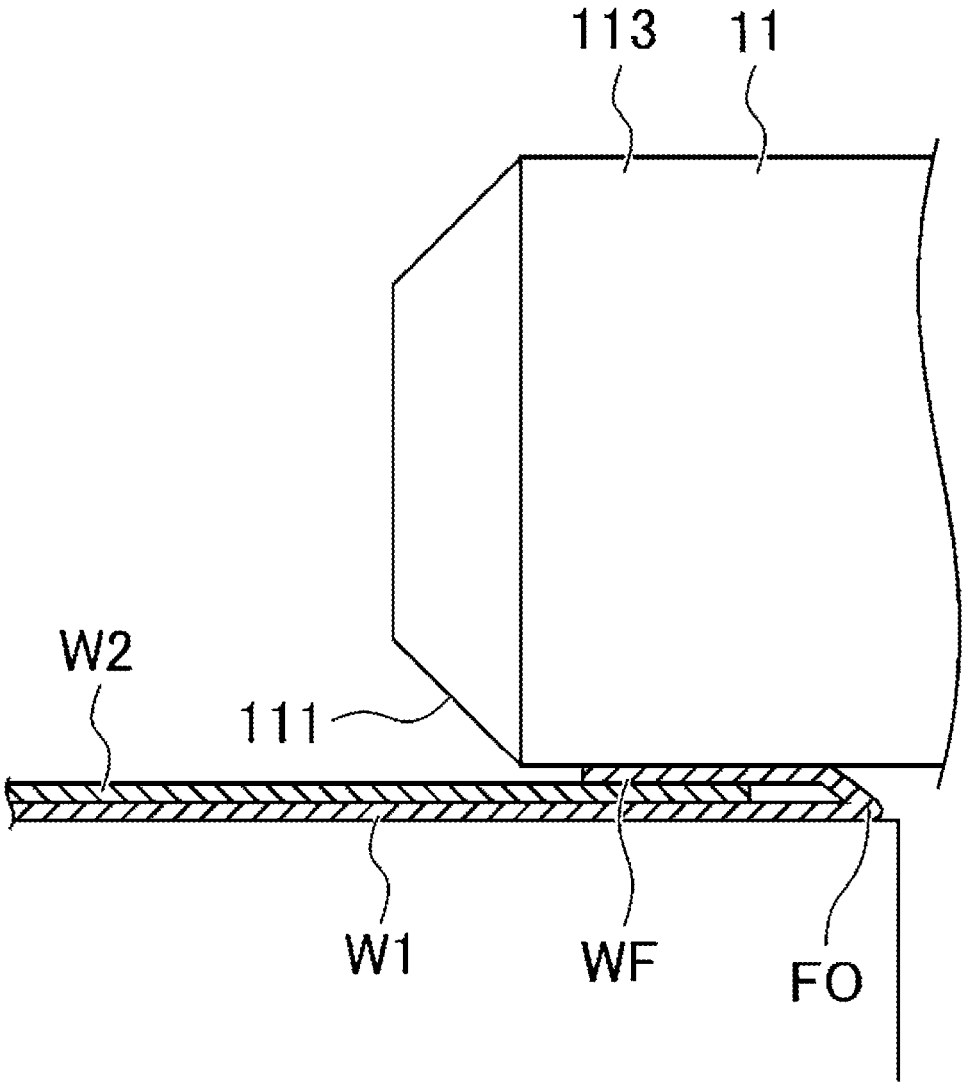
FIG. 6 is a view illustrating the machining roller mechanism according to the typical example, in a state where the machining roller mechanism performs another regular bending.

FIG. 6 is a view illustrating the machining roller mechanism 10 according to the typical example, in a state where the machining roller mechanism 10 performs another regular bending. Another regular bending can be performed using the large cylindrical surface 113 of the large diameter roller 11, as illustrated in FIG. 6. Therefore, when the large diameter roller 11 does not interfere with the inner panel W2 or the like, the regular bending can be properly performed using the large cylindrical surface 113 of the large diameter roller 11. In this case, the state is switched from the preliminary bending state illustrated in FIG. 3 to the regular bending state illustrated in FIG. 6, and the entirety of the hemming processing can be performed using only the large diameter roller 11 without using the small diameter roller 12. As a result, working time for switching the large diameter roller 11 to the small diameter roller 12 is not necessary.

The invention is not limited to the embodiment described above. Even when modification, improvement, or the like is applied to the invention within the range in which the object of the invention can be achieved, this is within the scope of the invention. In the typical example, the large cylindrical portion is provided in a large diameter roller and the small tapered surface is provided in the small diameter roller. However, both the large cylindrical portion and the small tapered surface may not be provided.

According to an embodiment, the roller hemming device 1 may include the large diameter roller 11 and the small diameter roller 12. The large diameter roller 11 has the large tapered surface 111 which performs the preliminary bending on the flange WF of the outer panel W1 at the predetermined bending angle. The small diameter roller 12 has the small cylindrical surface 123 which performs the regular bending on the flange WF to fold the flange WF. The small diameter roller 12 may be disposed coaxially with the large diameter roller 11. The small diameter roller 12 and the large diameter roller 11 may be relatively movable in the axial direction. The outer diameter of the small cylindrical surface 123 may be smaller than the minimum outer diameter of the large tapered surface 111.

According to this configuration, the preliminary bending is performed using the large tapered surface 111 of the large diameter roller 11. In the large tapered surface 111 of the large diameter roller 11, the circumferential ratio between the large-diameter portion and the small-diameter portion is small and the radius of curvature on the small-diameter portion side is large. Thus, the flange WF subjected to the preliminary bending is prevented from being in the wave shape. Furthermore, the regular bending is performed using the small cylindrical surface 123 of the small diameter roller 12. Thus, even in a case where an obstacle is located on the flange WF side, for example, when the inner panel W2 or the like protrudes up to a portion above the flange WF of the outer panel W1, on which hemming processing is to be performed, the small diameter roller 12 can enter through the gap above the flange WF. Accordingly, the small diameter roller 12 is prevented from interfering with the obstacle, and thus the regular bending can be properly performed. Therefore, when the preliminary bending is performed, the flange WF is prevented from being in a wave shape. In addition, when the regular bending is performed, the small diameter roller 12 is prevented from interfering with the obstacle. Thus, both preliminary bending and regular bending can be properly performed.

The small diameter roller 12 may protrude from the large diameter roller 11 through an axial pressing operation.

According to this configuration, since the large diameter roller 11 and the small diameter roller 12 can be switched through the axial pressing operation, it is possible to quickly switch the large diameter roller 11 and the small diameter roller 12. When switching of the roller is performed through the axial pressing operation, it is not necessary to provide a specific structure, such as a spline, on an outer circumferential surface of the small diameter roller 12 installed in the large diameter roller 11. Thus, the outer circumferential surface of the small diameter roller 12 can be formed into a smooth cylindrical surface. As a result, when the regular bending is performed using the small cylindrical surface 123 of the small diameter roller 12, the flange WF is prevented from being scratched.

In the large diameter roller 11, the large cylindrical surface 113 may continuously extend from the rear end side of the large tapered surface 111. In the small diameter roller 12, the small tapered surface 121 may continuously extend from the front end side of the small cylindrical surface 123.

According to this configuration, since the large diameter roller 11 and the small diameter roller 12 have the large tapered surface 111, the small tapered surface 121, the large cylindrical surface 113, and the small cylindrical surface 123, the optimal roller can be selected in the preliminary bending and the regular bending. Particularly, in a case where the small diameter roller 12 has the small tapered surface 121 which continuously extends from the front end side of the small cylindrical surface 123, even when the inner panel W2 or the like protrudes up to the portion above the flange WF of the outer panel W1, on which hemming processing is performed, the small diameter roller can enter through the gap above the flange WF. Accordingly, the small diameter roller 12 is prevented from interfering with the obstacle. As a result, even in the case described above, the preliminary bending can be properly performed.

According to an embodiment, a roller hemming method may be performed using a roller hemming device which includes the large diameter roller 11 and the small diameter roller 12. The large diameter roller 11 has the large tapered surface 111. The small diameter roller 12 has the small cylindrical surface 123 and is movable in the axial direction, relative to the large diameter roller 11 installed coaxially with the large diameter roller 11. The roller hemming method may include a preliminary bending step and a regular bending step. In the preliminary bending step, the flange WF of the outer panel W1 of the workpiece W is subjected to the preliminary bending at the predetermined bending angle, using the large tapered surface 111. In the regular bending step, the flange WF processed in the preliminary bending step is subjected to the regular bending, using the small cylindrical surface 123, such that the flange WF is folded.

According to this method, the flange subjected to the preliminary bending is prevented from being a wave shape and a roller for the regular bending is prevented from interfering with an obstacle. Thus, both preliminary bending and regular bending can be properly performed.

In an interval between the preliminary bending step and the regular bending step, the small diameter roller 12 and the large diameter roller 11 may be relatively moved in the axial direction, such that the front-end side protrusion amount of the front end surface 122 of the small diameter roller 12 in the axial direction, relative to the front end surface 112 of the large diameter roller 11 in the axial direction increases.

The invention claimed is:

1. A roller hemming device, comprising:

a large diameter roller which has a large tapered surface for performing a preliminary bending on a flange of a workpiece at a predetermined bending angle; and a small diameter roller which has a small cylindrical surface for performing a regular bending to fold the flange, wherein the small diameter roller is coaxially disposed with the large diameter roller, the small diameter roller and the large diameter roller are enabled to relatively move in an axial direction, an outer diameter of the small cylindrical surface is smaller than a minimum outer diameter of the large tapered surface, and the small diameter roller protrudes from the large diameter roller through an axial pressing operation.

2. The roller hemming device according to claim 1, wherein the large diameter roller has a large cylindrical surface which continuously extends from a rear end side of the large tapered surface, and the small diameter roller has a small tapered surface which continuously extends from a front end side of the small cylindrical surface.

3. A roller hemming method using a roller hemming device which includes a first diameter roller which has a large tapered surface and a second diameter roller which has a smaller diameter than the first diameter roller, has a small cylindrical surface, is coaxially disposed with the first diameter roller, and is enabled to move relative to the first diameter roller in an axial direction, the method comprising:

a preliminary bending step in which a flange of a workpiece is subjected to a preliminary bending at a predetermined bending angle, using the large tapered surface; and a regular bending step in which the flange processed in the preliminary bending step is subjected to a regular bending to fold the flange, using the small cylindrical surface of the second diameter roller which is protruded from the first diameter roller through an axial pressing operation.

4. The roller hemming method according to claim 3, wherein the small diameter roller and the large diameter roller relatively move in the axial direction in an interval between the preliminary bending step and the regular bending step such that a front-end side protrusion amount of a front end surface of the small diameter roller in the axial direction, relative to a front end surface of the large diameter roller in the axial direction increases.

* * * * *